US006904902B2

(12) United States Patent
Axelsson

(10) Patent No.: US 6,904,902 B2
(45) Date of Patent: Jun. 14, 2005

(54) AIRGUN WITH AIRFLOW CONTROL

(75) Inventor: Fredrik Axelsson, Mariestad (SE)

(73) Assignee: FX Airguns AB, Hova (SE)

( * ) Notice: Subject to any disclaimer, the term of this patent is extended or adjusted under 35 U.S.C. 154(b) by 0 days.

(21) Appl. No.: 10/491,239

(22) PCT Filed: Sep. 26, 2002

(86) PCT No.: PCT/SE02/01740

§ 371 (c)(1),
(2), (4) Date: Mar. 30, 2004

(87) PCT Pub. No.: WO03/036218

PCT Pub. Date: May 1, 2003

(65) Prior Publication Data

US 2004/0237953 A1 Dec. 2, 2004

(30) Foreign Application Priority Data

Oct. 2, 2001 (SE) ..... 0103277

(51) Int. Cl.[7] ..... F41B 11/00
(52) U.S. Cl. ..... 124/73
(58) Field of Search ..... 124/73, 74, 75, 124/76, 77, 41.2, 48

(56) References Cited

U.S. PATENT DOCUMENTS 3,385,279 A * 5/1968 Pitcher ..... 124/67
3,420,220 A 1/1969 Ferrando
3,913,553 A * 10/1975 Braughler et al. ..... 124/73
5,265,582 A 11/1993 Bhogal
5,333,594 A 8/1994 Robinson
6,276,354 B1 8/2001 Dillon
6,311,681 B1 * 11/2001 Snyder, Jr. ..... 124/59

* cited by examiner

*Primary Examiner*—Michael Carone
*Assistant Examiner*—Troy Chambers
(74) *Attorney, Agent, or Firm*—Burns, Doane, Swecker & Mathis, LLP

(57) ABSTRACT

An airgun comprising a valve intended to be in contact with a compressed air cartridge, a barrel, into which a bullet is insertable, and a passageway connecting the valve with the barrel. Moreover, the airgun has element with a plurality of through holes of different diameters, which element is arranged in the passageway so that a part of the element comprising at least one of said holes extends transversely of the passageway. The diameter of the hole or holes which is/are positioned in the passageway thus defines the effective cross-section of the passageway and, consequently, the flow through the passageway. This means that the invention offers a better possibility of controlling the air flow.

7 Claims, 3 Drawing Sheets

AIRGUN WITH AIRFLOW CONTROL

FIELD OF THE INVENTION

The present invention relates to an airgun, such as an air rifle or air pistol, comprising a valve intended to be in contact with a compressed air cartridge, a barrel into which a bullet is insertable, and a passageway connecting the valve with the barrel.

BACKGROUND ART

Airguns of the above type operated by compressed air from a cartridge which is connected to the airgun are well known. Owing to the relatively great pressure in the cartridge, the airgun can be fired with great accuracy also at a long range. This great pressure, however, is not always necessary, and then there may be a need for controlling the airflow through the passageway which extends from the air cartridge to the bullet.

In the air pistol disclosed in U.S. Pat. No. 5,333,594, an adjustable screw is arranged to offer a possibility of adjusting the air pressure. Similar adjusting screws may be used in air rifles.

However, such an adjusting screw has several drawbacks. First, the screw must be relatively firmly tightened so as to prevent gas from leaking through the thread, and therefore some kind of implement is usually required to turn the screw (poor user-friendliness). Second, it is difficult for the user to determine how the screw is set by observing it. Instead it is necessary to fire a trial shot in order to assess whether an adjustment is necessary (poor efficiency). Third, it is difficult to repeat a change of the setting with sufficient accuracy (poor repeatability).

SUMMARY OF THE INVENTION

The object of the present invention is to provide an air-operated gun which offers a different possibility of controlling the airflow.

This and other objects are achieved by a gun of the type mentioned by way of introduction, further comprising a flow-controlling element with a plurality of through holes of different diameters, said element being arranged in the passageway so that a part of the element comprising at least one of said holes extends transversely of the passageway.

The diameter of the hole or holes that is/are positioned in the passageway thus defines the effective cross-section of the passageway and, thus, the flow through the passageway. This means that the invention offers an improved possibility of controlling the airflow.

The element can be movably arranged in the passageway to enable selective insertion of one of said holes into the passageway. In this manner, a plurality of different distinct positions can be set, each with an unambiguously defined flow.

According to one embodiment of the invention, the element is disc-shaped and is arranged rotatably in its horizontal plane. By rotating the disc, the user can insert a selected hole into the passageway.

Suitably a part of the element extends outside the body of the airgun, so as to be accessible from the outside of the airgun. The element may thus be operated by contact with this part, for instance by the user using the thumb or index finger of his one hand. This eliminates the need for special implements.

Preferably, the disc-shaped element is arranged to take predetermined positions, in which a hole is inserted into the passageway. Thus the user runs a smaller risk of inadvertently placing the element in an incorrect position. Such an arrangement can be achieved, for instance, by notches along the periphery of the element which coact with a catch.

Preferably, the disc-shaped element is provided with external marks, which are visible to the user and which indicate which hole/holes is/are positioned in the passageway. This makes it possible for a user to be quite sure about which flow for the time being is set by means of the flow-controlling element.

BRIEF DESCRIPTION OF THE DRAWINGS

A currently preferred embodiment of the invention will now be described in more detail with reference to the accompanying drawings.

DESCRIPTION OF A PREFERRED EMBODIMENT

Figure 1:
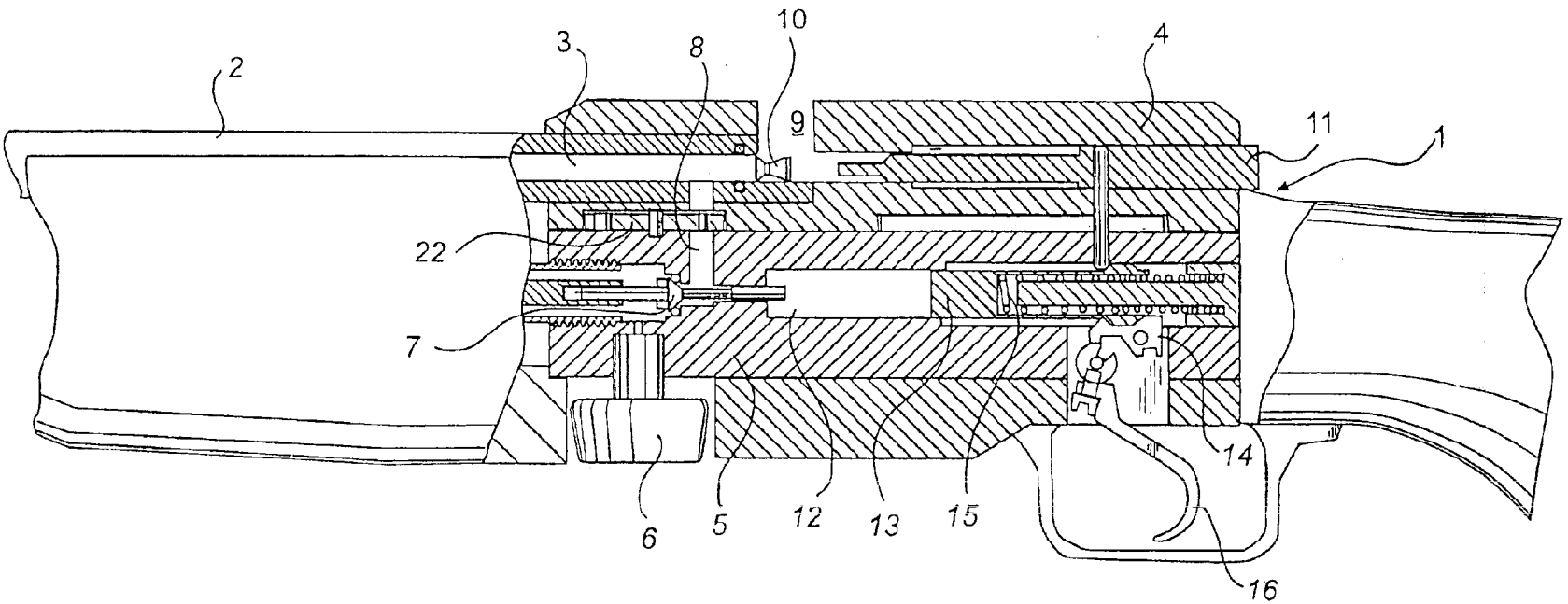
FIG. 1 shows partly in cross-section part of an airgun provided with a flow-controlling element according to the invention.
Figure 2:
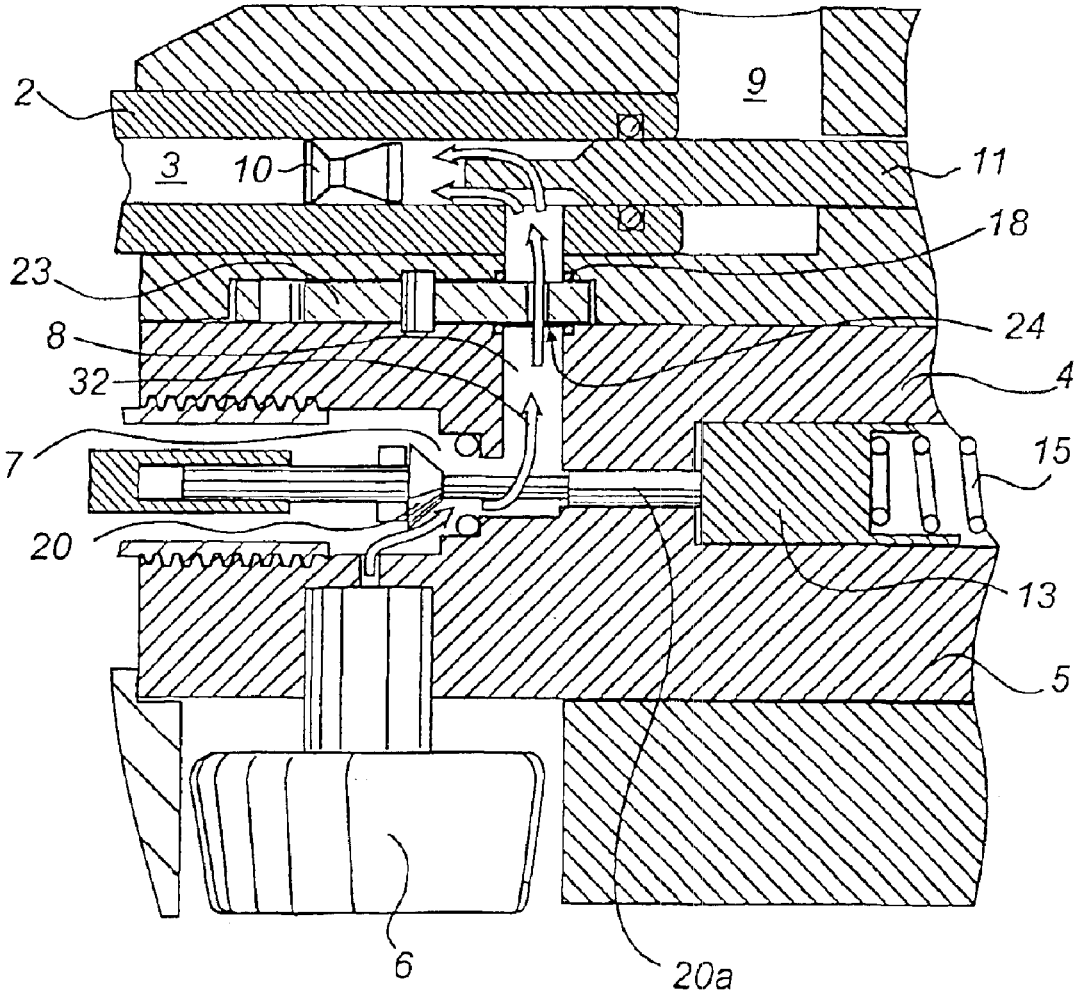
FIG. 2 is a perspective view of part of the airgun in FIG. 1, comprising the element.
Figure 3:
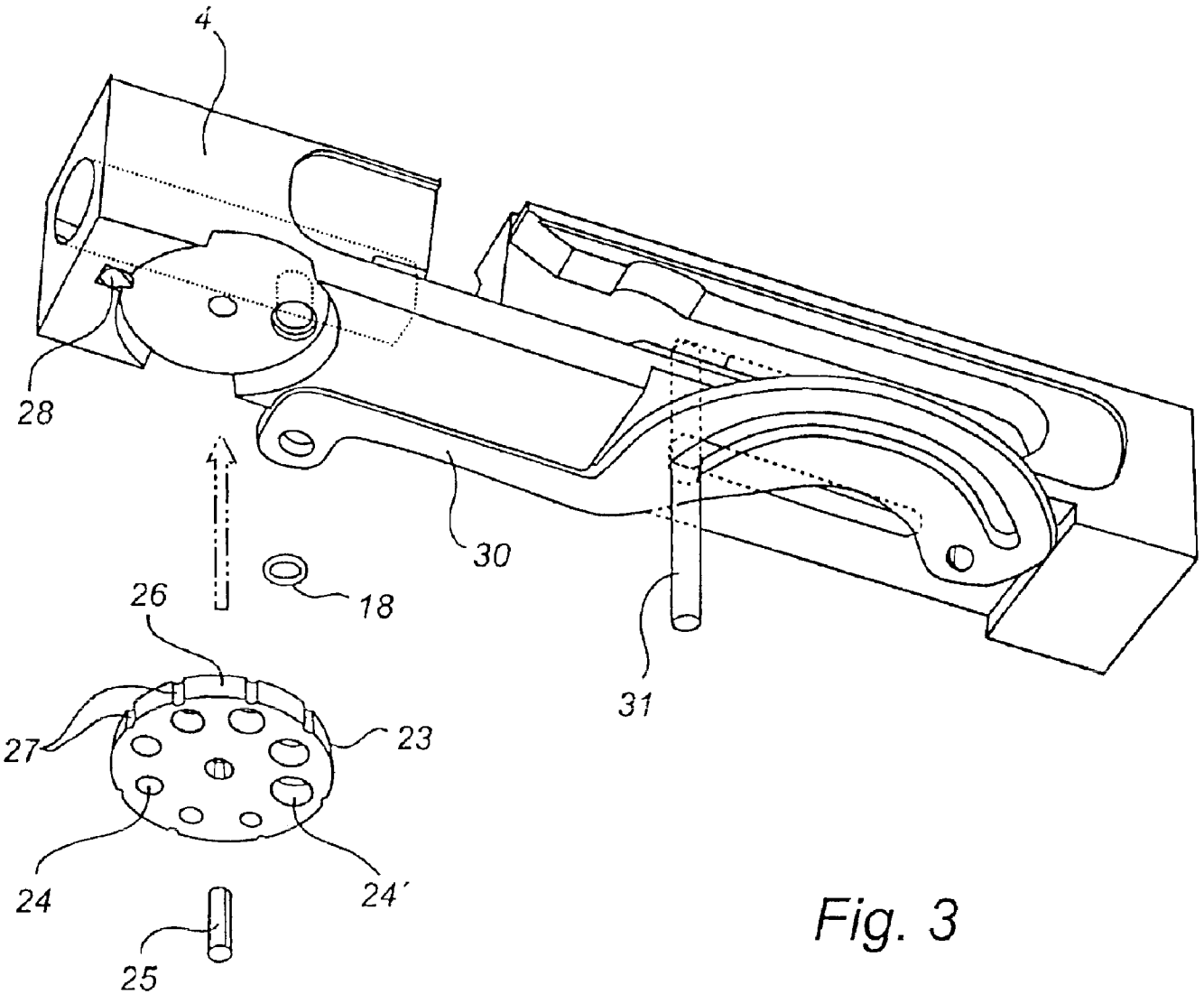
FIG. 3 shows an enlarged part of FIG. 1.

The airgun shown in FIGS. 1–3 comprises a butt 1 and a barrel 2. The butt comprises an upper and a lower block 4, 5. The lower block has a connection 6 to allow connection of a cartridge (not shown) for pressurised gas, usually air. The connection 5 of the cartridge is, via a valve 7 accommodated in the block 5, connected with a passageway 8 extending through the blocks 4 and 5 up to the bore 3 of the barrel 2. The passageway leads to a position where a bullet 10 located in a charging compartment 9 can be inserted by a feeding pin 11.

The block 5 also has a space 12 behind the valve 7 in which a hammer 13 is slidably movable between a first position in which it is lockable by means of a hook 14 (see FIG. 1), and a second position in which it strikes against the valve cone of the valve 7 (see FIG. 2). The hammer 13 is spring-loaded towards the valve 7 by means of a helical spring 15. A cock 16 is arranged in connection with the hook 14 in order to actuate the hook 14 to release the hammer 13.

With reference to FIG. 2, it is shown more distinctly how the valve 7 has a valve cone 20 which in a spring-loaded manner seals against a seat 21. The valve cone has a rear portion 20*a* extending a distance outside the valve 7 into the space 12.

According to the invention, a flow-controlling element 22 is further arranged in the passageway 8. The element 22, which is mounted between the blocks 4 and 5, is sealed against the block 4 and the block 5, respectively, by means of two O rings 18, 19 extending round the passageway 8.

The element, which is best seen in FIG. 3, comprises in the illustrated embodiment a disc 23 with a plurality of through holes 24 of different sizes. In FIG. 3, the disc 23 is rotatably arranged in the upper block 4 by means of a pin 25 or the like. The disc is arranged at the underside of the block 4 so that a part of the disc 23, with at least one hole 24', extends over the entire cross-section of the passageway 8. This hole 24' thus forms part of the extension of the passageway 8 and reduces the effective cross-section thereof, i.e. throttles the flow through the passageway. By rotating the disc, a selected hole can be inserted into the passageway 8.

As is also shown in FIG. 3, a part 26 of the disc 23 extends a distance outside the side of the block 4, which makes it accessible for operation by a user, using for instance his finger. Conveniently the disc 23 is further provided with notches 27 which may cooperate with a resilient catch 28. Thus the disc is rotatable between a plurality of discrete positions, each corresponding to a location of a predetermined hole 24 in the passageway 8. Marking of the side of the disc 23 makes it possible for a user to know which hole 37 is Placed in the passageway and, thus, the cross-section of the passageway.

An operating handle 30 is arranged to move a driver 31 rearwards to the barrel by the user making a pivoting motion. The driver 31 is arranged to drive, in its rearward motion, the hammer 13 and the feeding pin 11.

When using the airgun, the operating handle 30 is moved outwards and rearwards, whereby the driver 31 drives the hammer 13 against the action of the spring 15 to its rear position where it is locked by the hook 14 (see FIG. 1). At the same time the feeding pin 11 is moved backwards, past the compartment 9, and thus enables the insertion of a bullet 10 into the compartment 9 (see FIG. 1). Subsequently the operating handle 30 is returned to its starting position, the hammer 13 being retained by the hook 14, while the feeding pin 11 is returned to its front position (FIG. 2) and, thus, presses the bullet 10 into the bore 3. The airgun is now loaded.

When the cock 16 is then pressed, the hook 14 is allowed to release the hammer 13 which is pressed forward to the valve 7 by means of the spring 15. When the hammer 13 strikes against the projecting portion 20*a* of the valve cone 20, the valve cone is moved from its closed position against spring action, and air is allowed to pass the valve and through the passageway 8 up to the bore 3. This flow of air is best seen in FIG. 2, reference numeral 32. As soon as the motion of the hammer 13 has been braked, the valve cone 20 is caused to return to its closed position by the spring force. It is the amount of air that has passed the valve 7 which causes firing of the bullet 10.

On its way through the passageway 8, the flow of air passes through that hole 24' in the disc 23 which is positioned in the passageway 8. The size of this hole determines the size of the flow and, thus, the force that will act on the bullet 10.

Between shots, a user may rotate the disc 23 by contacting the part 26 and, thus, change the flow that can pass through the passageway 8. This allows easy trimming of the airgun according to the conditions. For instance, it may be convenient to insert a larger hole 24 when firing at a long range.

It should be noted that the shape of the element 22 may be varied. For example, a long narrow sheet with holes arranged in a row may be slidingly arranged in the passageway, so that a user, by moving the sheet to the correct position, may insert the desired hole into the passageway. It is also possible to fixedly arrange the element 22 in a predetermined position, e.g. by means of a screw. Although this reduces the flexibility for the user, it may in some situations be desirable.

What is claimed is:

1. An airgun comprising a valve (7) intended to be in contact with a compressed air cartridge, a barrel (2), into which a bullet (10) is insertable, and a passageway (8) connecting the valve (7) with the barrel (2), wherein a flow-controlling element (23) with a plurality of through holes (24) of different diameters, said element being arranged in the passageway (8) so that a part of the element comprising at least one of said holes (24) extends transversely of the passageway.

2. An airgun as claimed in claim 1, wherein said element (23) is movably arranged in the passageway to enable selective insertion of one of said holes (24) into the passageway (8).

3. An airgun as claimed in claim 2, wherein the element (23) is disc-shaped and is arranged rotatably in its horizontal plane.

4. An airgun as claimed in claim 2, wherein a part (26) of the element (23) is accessible from the outside of the airgun so that the element can be operated by contact with said part.

5. An airgun as claimed in claim 3, wherein the disc-shaped element (23) is arranged to take predetermined positions, in which a hole (24) is inserted into the passageway (8).

6. An airgun as claimed in claim 3, wherein the disc-shaped element (23) is provided with external marks which are visible to the user and which indicate which hole/holes is/are positioned in the passageway.

7. An airgun as claimed in claim 3, wherein a part (26) of the element (23) is accessible from the outside of the airgun so that the element can be operated by contact with said part.

* * * * *